US010661959B2

(12) United States Patent
Martin et al.

(10) Patent No.: US 10,661,959 B2
(45) Date of Patent: May 26, 2020

(54) DEVICE AND DISPLAY PACKAGE ASSEMBLY

(71) Applicant: Medline Industries, Inc., Northfield, IL (US)

(72) Inventors: Tambra Martin, Trevor, WI (US); Christopher J. Miller, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 85 days.

(21) Appl. No.: 16/127,490

(22) Filed: Sep. 11, 2018

(65) Prior Publication Data

US 2019/0092544 A1 Mar. 28, 2019

Related U.S. Application Data

(60) Provisional application No. 62/564,125, filed on Sep. 27, 2017.

(51) Int. Cl.

| | |
|---|---|
| ***B65D 75/14*** | (2006.01) |
| ***B65D 73/00*** | (2006.01) |
| ***A45B 9/00*** | (2006.01) |
| ***B65D 85/20*** | (2006.01) |
| ***A45B 7/00*** | (2006.01) |
| ***A45B 1/04*** | (2006.01) |

(52) U.S. Cl.

CPC ..... *B65D 73/0085* (2013.01); *A45B 1/04* (2013.01); *A45B 7/005* (2013.01); *A45B 9/00* (2013.01); *B65D 73/0078* (2013.01); *B65D 85/20* (2013.01); *A45B 2009/002* (2013.01); *A45B 2009/007* (2013.01); *B65D 2201/00* (2013.01)

(58) Field of Classification Search

CPC ..... B65D 73/0085; B65D 73/0078; B65D 85/20; B65D 75/14; B65D 5/2052; B65D 71/12; B65D 2571/00123; A45B 7/005; A45B 9/00

USPC ..... 229/103.2, 103.3; 206/495

See application file for complete search history.

(56) References Cited

U.S. PATENT DOCUMENTS

| | | | | | |
|---|---|---|---|---|---|
| 1,230,401 | A * | 6/1917 | Gold | B65D 73/0014 206/495 |
| 3,884,350 | A | 5/1975 | Johansson | |
| 4,401,255 | A | 8/1983 | Conroy | |
| D274,407 | S | 6/1984 | Rosenburg, Jr. | |
| D337,047 | S | 7/1993 | Pearce | |
| 5,328,137 | A | 7/1994 | Miller | |
| 5,499,484 | A | 3/1996 | Herrin | |
| 5,697,502 | A * | 12/1997 | Linz | B65D 73/0085 206/779 |
| D400,097 | S | 10/1998 | Von Stein | |
| D405,369 | S | 2/1999 | Dohner | |

(Continued)

*Primary Examiner* — King M Chu

(74) *Attorney, Agent, or Firm* — Fitch, Even, Tabin & Flannery LLP

(57) ABSTRACT

Disclosed is an assembly that comprises a user mobility device and a display package. The user mobility device comprises a handle region covered by a handle cover. The display package provided with a hanging panel having a hang tab region that extends past the handle region of the user mobility device and having a hanging aperture and a boundary that defines an open region proximal to handle region of the user mobility device to permit manual grasping of the handle region without the necessity to remove the user mobility device from the display package.

16 Claims, 15 Drawing Sheets

(56) References Cited

U.S. PATENT DOCUMENTS

| | | | | |
|---|---|---|---|---|
| D440,873 | S | 4/2001 | Van Horn | |
| 6,305,597 | B1 * | 10/2001 | Donegan | B65D 5/4204 206/806 |
| 6,382,676 | B1 | 5/2002 | Cochran | |
| 6,508,357 | B1 | 1/2003 | Faircloth | |
| 6,612,059 | B2 | 9/2003 | Cochran | |
| 7,219,829 | B2 | 5/2007 | Treat | |
| D571,210 | S | 6/2008 | Rozanski | |
| 8,186,513 | B2 * | 5/2012 | St. John | B65B 11/004 206/495 |
| D681,444 | S | 5/2013 | Oja | |
| D699,582 | S | 2/2014 | Baum | |
| D736,098 | S | 8/2015 | Burger | |
| D762,465 | S | 8/2016 | Popper | |
| D763,675 | S | 8/2016 | McDonald | |
| D767,385 | S | 9/2016 | McDonald | |
| D825,324 | S | 8/2018 | Cavalcante | |
| D832,097 | S | 10/2018 | Lee | |
| D833,860 | S | 11/2018 | Lee | |
| 1,029,251 | A1 | 5/2019 | Peterson | |
| 2013/0277272 | A1 | 10/2013 | Oja | |
| 2014/0103100 | A1 * | 4/2014 | Falcon | B65D 5/4204 229/103.2 |
| 2016/0262592 | A1 | 9/2016 | Mongeon | |
| 2019/0092544 | A1 | 3/2019 | Martin | |

* cited by examiner

DEVICE AND DISPLAY PACKAGE ASSEMBLY

RELATED APPLICATION

This application claims the benefit of U.S. provisional patent application No. 62/564,125 filed Sep. 27, 2017, which is incorporated herein by reference in its entirety.

TECHNICAL FIELD

The disclosure is in the field of point-of-sale packaging, in particular for user mobility devices in certain embodiments.

BACKGROUND

User mobility devices are frequently purchased at retail locations. Many user mobility devices, in particular, walking canes, are bulky and difficult to display properly. Canes typically are provided with a telescoping collapsible shaft, which allows the length of the cane to be reduced for packaging and display. This mitigates some of the difficulty in displaying walking canes. Nonetheless, it can be difficult to package the cane in a way that allows the cane to hang in a substantially straight manner from a hanging rack, and that also permits a user to test the cane without removing the package by manually grasping the handle of the cane.

It has now been found that an assembly that comprises a user mobility device and a display package may be provided. The user mobility device comprises a handle region covered by an optional handle cover, a transition region, and a support region. The display package includes a front panel and a rear panel, first and second side panels, and top and bottom panels, each of the top and bottom panels having apertures for accommodating protruding portions of the walking cane or other user mobility device. The package is provided with a hanging panel having a hang tab region that extends past the handle region of the user mobility device and having a hanging aperture. The panels collectively define a container that is sized to envelope at least a portion of the mobility device and that further is sized to retain the mobility device in a hanging position, preferably a substantially vertical hanging position. The hanging panel has a boundary that defines an open region proximal to handle region of the user mobility device to permit manual grasping of the handle region without the necessity to remove the user mobility device from the display package. The user thus may test the cane at the point of purchase without removing the cane from the display package.

BRIEF DESCRIPTION OF THE FIGURES

The disclosed embodiments can be better envisioned with respect to the accompanying figures, in which.

DETAILED DESCRIPTION

Figure 1:
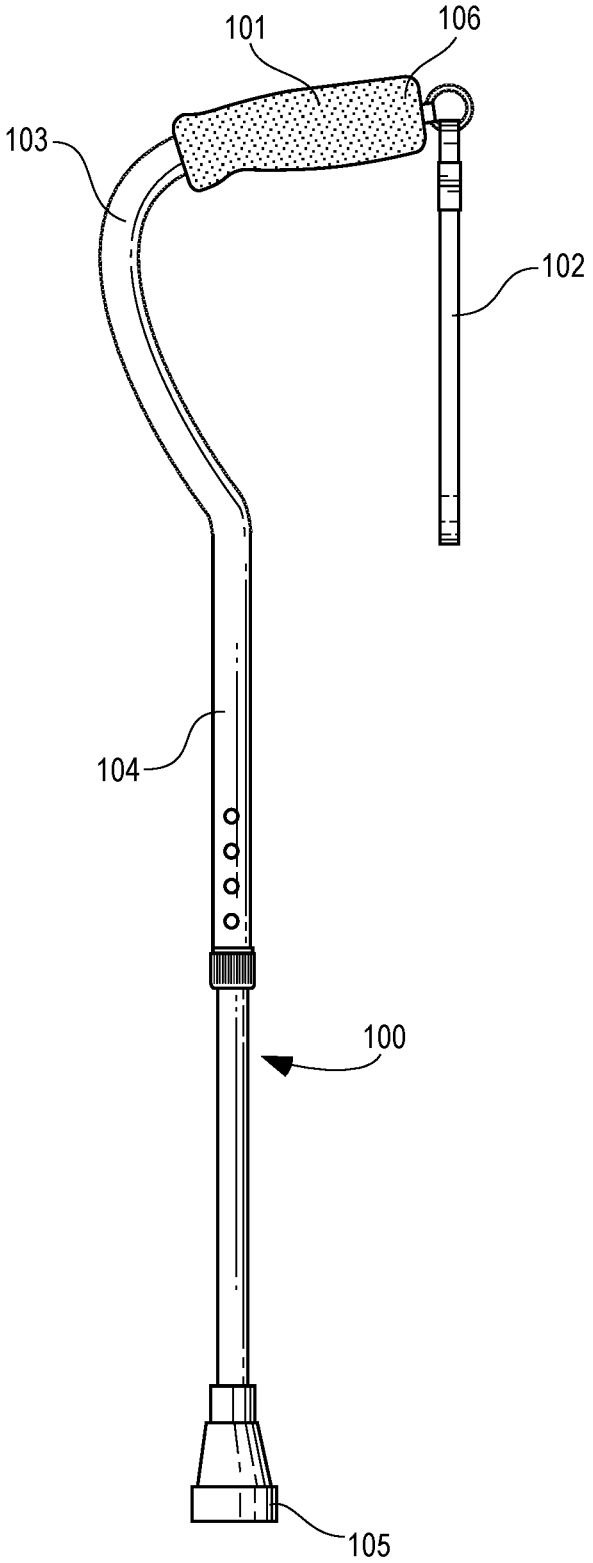
FIG. 1 is a perspective view of a user mobility device in the form of a cane.
Figure 2:
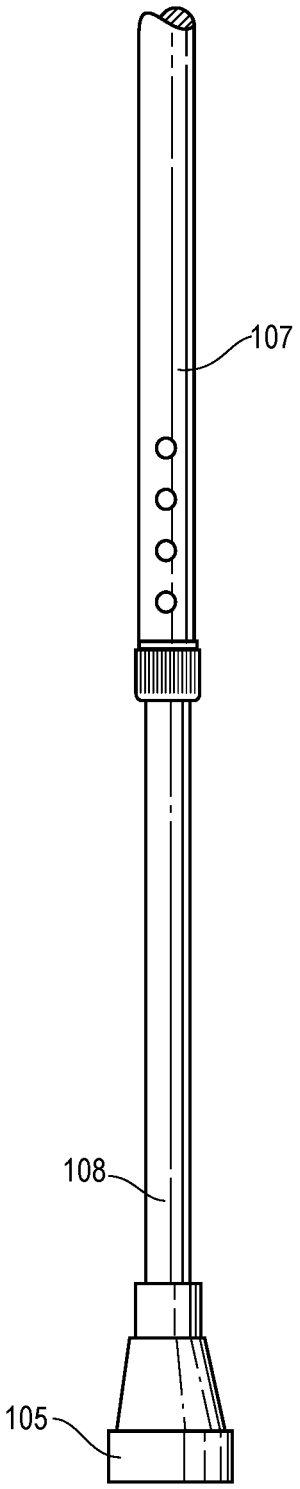
FIG. 2 is a perspective view of a portion of the cane when the shaft of the cane has been extended.
Figure 3:
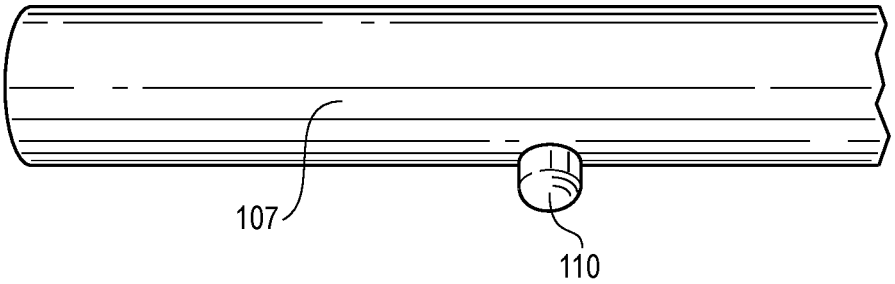
FIG. 3 is a perspective view of an upper portion of the shaft of the cane, illustrating a locking button.
Figure 3A:
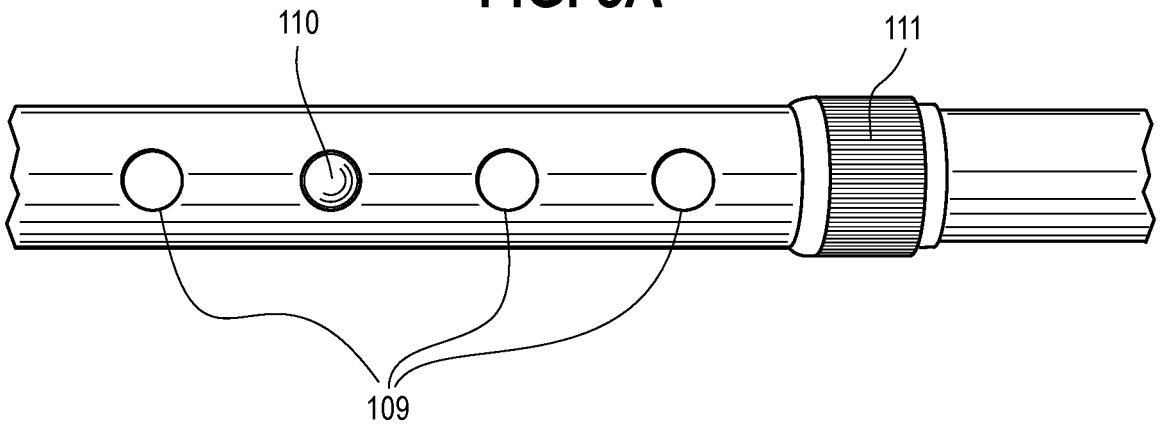
FIG. 3A is a perspective view of the locking button in engagement with the lower part of the telescoping shaft of the cane showing in FIG. 1.
Figure 4:
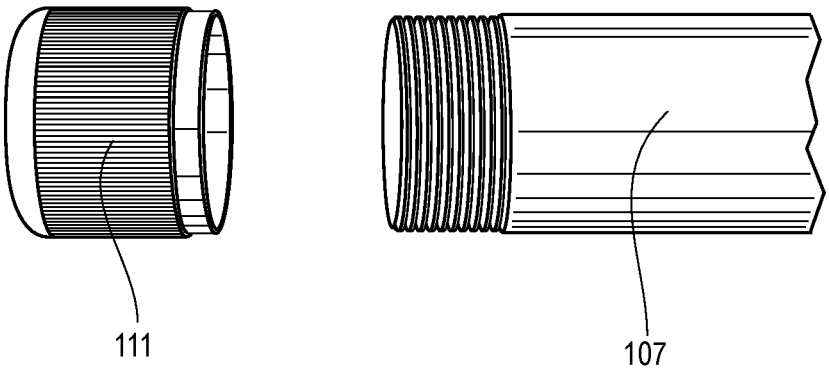
FIG. 4 is a disassembled perspective view showing a lower region of the bottom portion of the telescoping shaft of the cane shown in FIG. 1.
Figure 5:
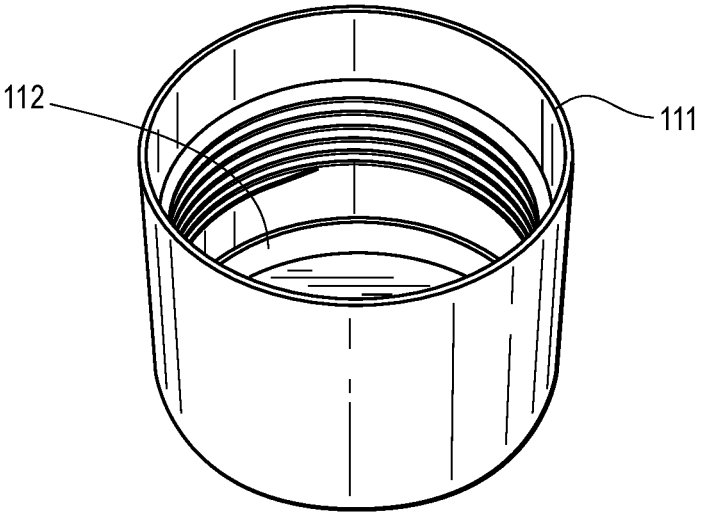
FIG. 5 is a perspective view of the retaining ring assembly of the cane shown in FIG. 1.
Figure 6:
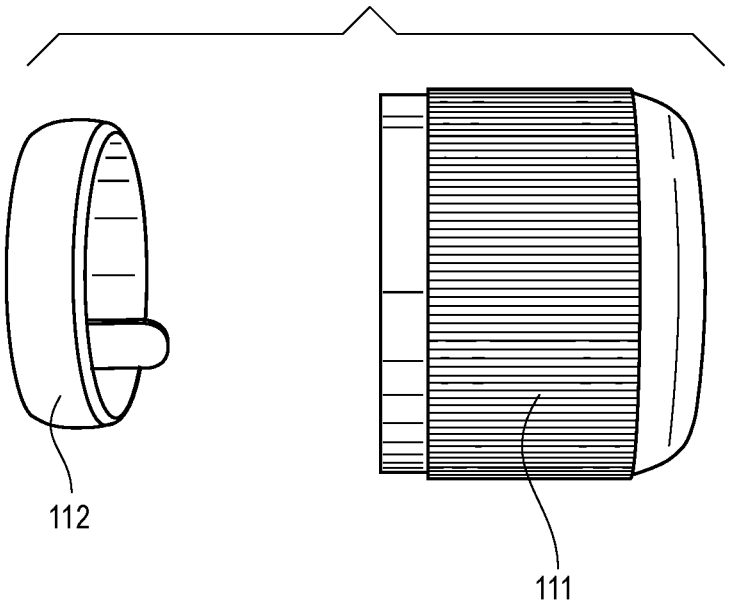
FIG. 6 is an exploded view of the retaining ring assembly shown in FIG. 5.

With reference now to FIG. 1, the illustrated user mobility device is in the form of the cane 100, which, in the illustrated embodiment includes a user gripping portion 101 having a soft covering grip 106, the grip being equipped with a user handle strap 102. The cane further includes a transition region 103 and an elongate shaft 104 terminating in a thermoplastic foot 105. As further seen in FIG. 2, the shaft comprises an upper portion 107 and lower portion 108 which are arranged in telescoping relationship with respect to one another. As seen in FIGS. 3 and 3A, the upper portion of the shaft 107 is equipped with a spring-loaded retention pin 110 and the lower portion of the shaft is equipped with a series of retention apertures 109 to enable the user to adjust the overall height of the shaft. In practice, the positions of the pin and apertures may be reversed. The upper portion of the shaft 107 is equipped with a threaded end cap 111, further shown in FIGS. 4-6. The cap 111 may be threadably attached to the upper portion, the purposes of which are to secure the lower portion to the upper portion and to cause frictional retention of the lower portion 108 on the upper portion 107. As best shown in FIGS. 5 and 6, the cap is equipped with a thermoplastic retention washer 112.

In this respect, the cane may be conventional. The cane may be imparted with various aesthetic surface designs, and further may be equipped with a surface that has a antimicrobial properties. The cane and its various components may be made of any suitable materials.

Figure 7:
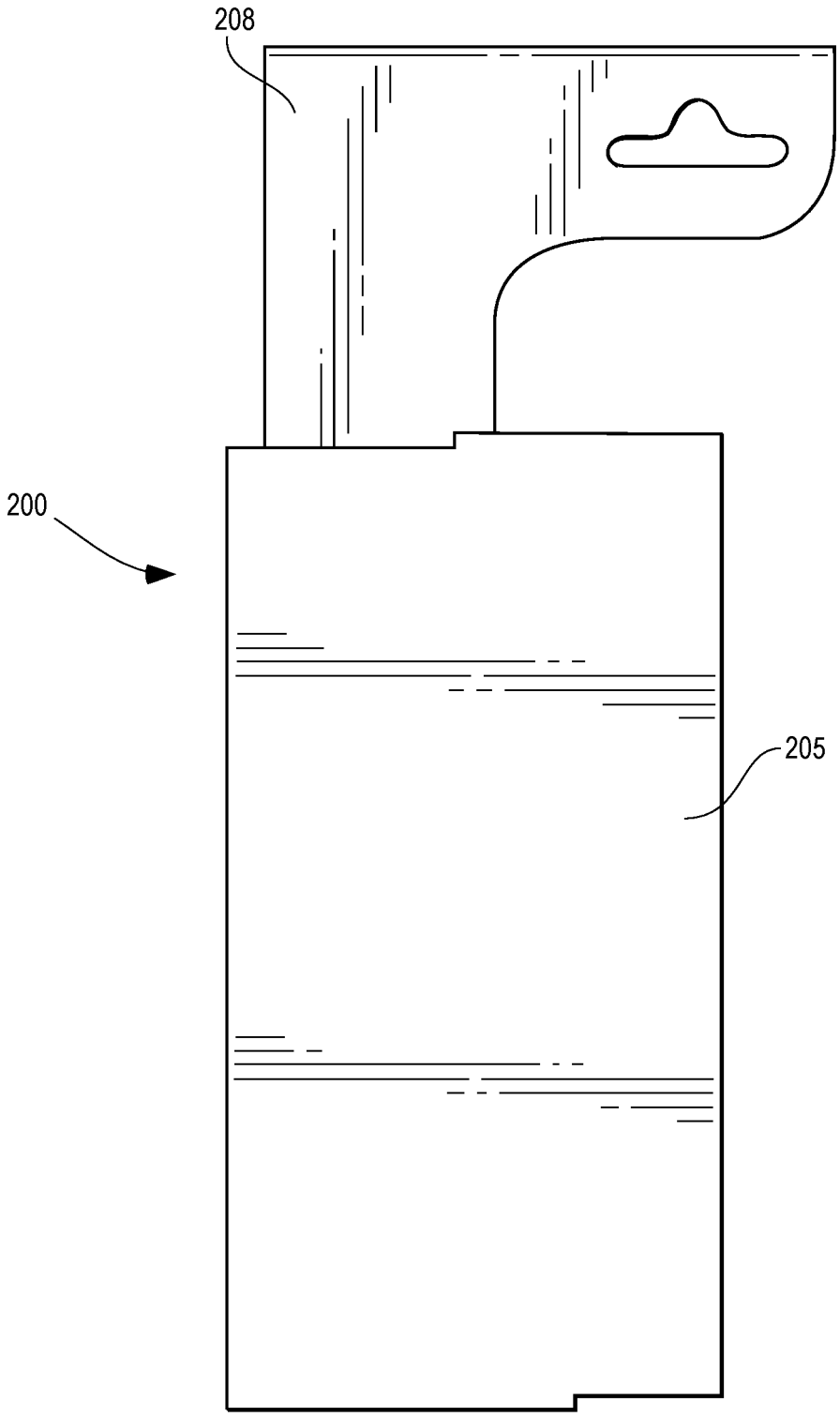
FIG. 7 is a front elevational view of a display package useful for displaying the cane shown in FIG. 1.
Figure 8:
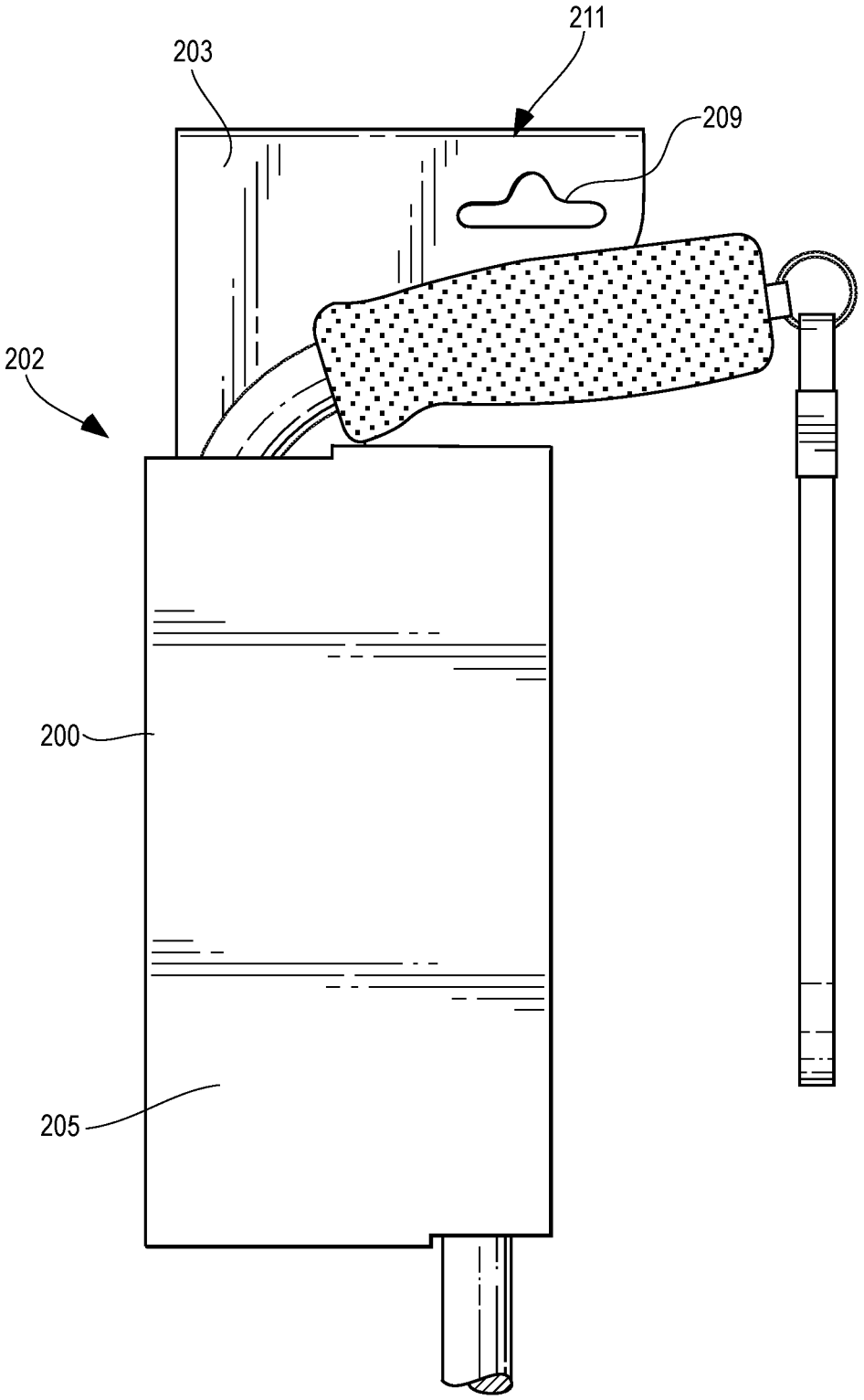
FIG. 8 is a front elevational view of an assembly that includes the package and cane heretofore illustrated.

With regard to the package 200 and assembly 202 shown in FIGS. 7 and 8, it is seen that the package includes a front panel 205 which is sized for display of graphics and consumer information. The package is equipped with a hanging panel 203 that has a hang tab region 211 having a hanging aperture 209. The aperture 209 may take any suitable form. In the illustrated embodiment, the aperture takes the form of a slot.

Figure 9:
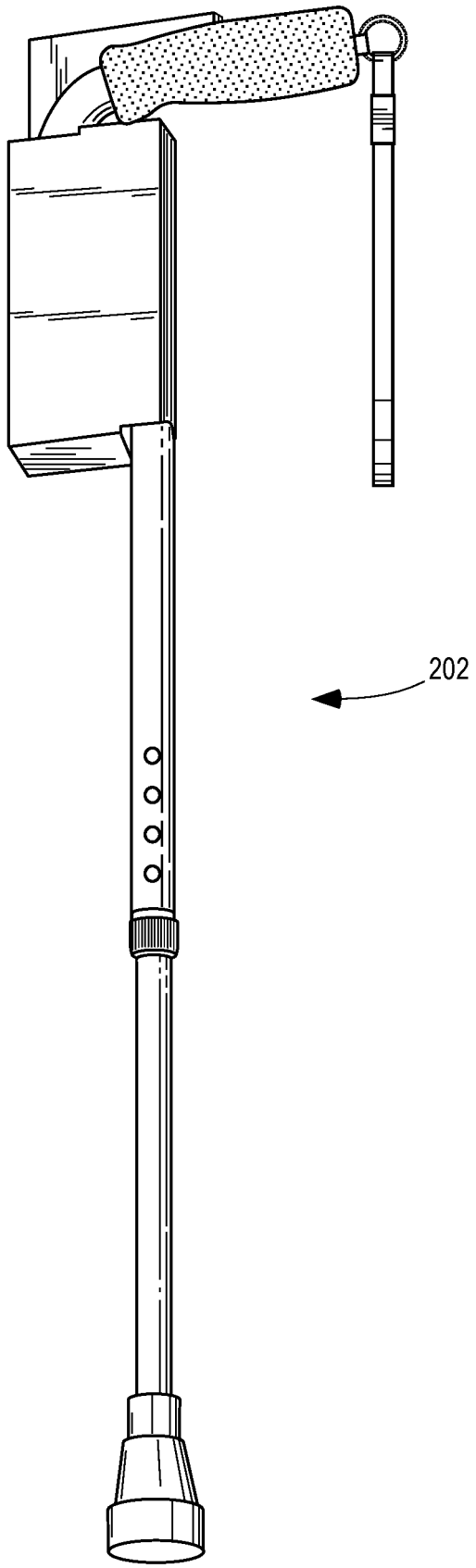
FIG. 9 is another perspective view of the assembly shown in FIG. 8 in reduced perspective.
Figure 10:
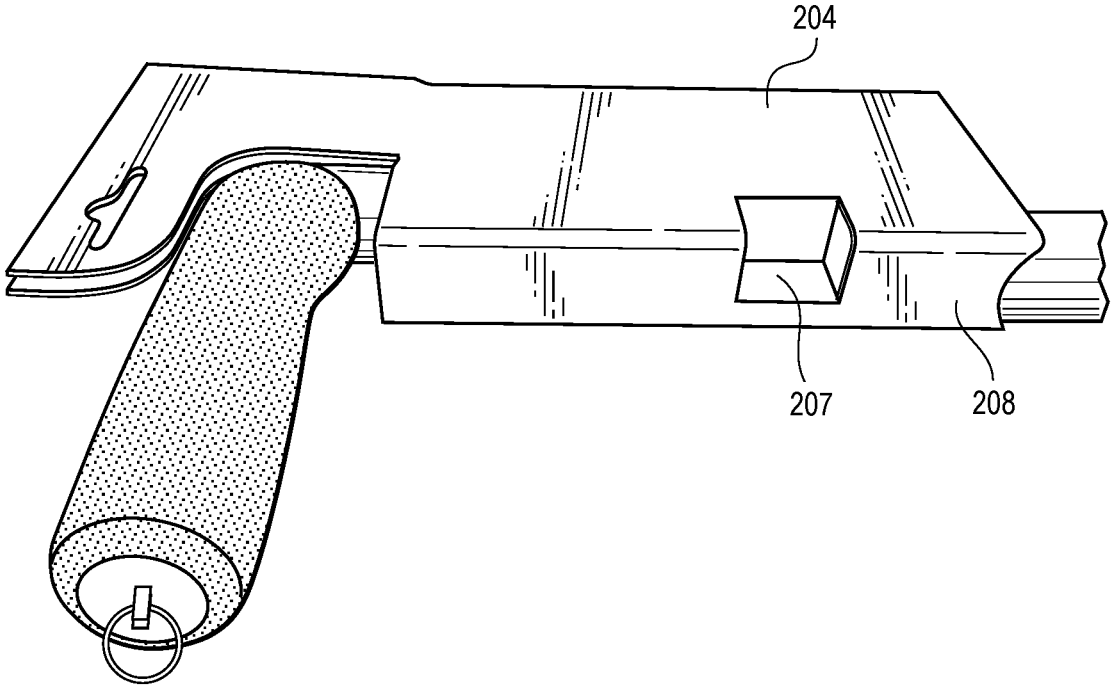
FIG. 10 is a perspective view illustrating a second side panel of the display package.
Figure 11:
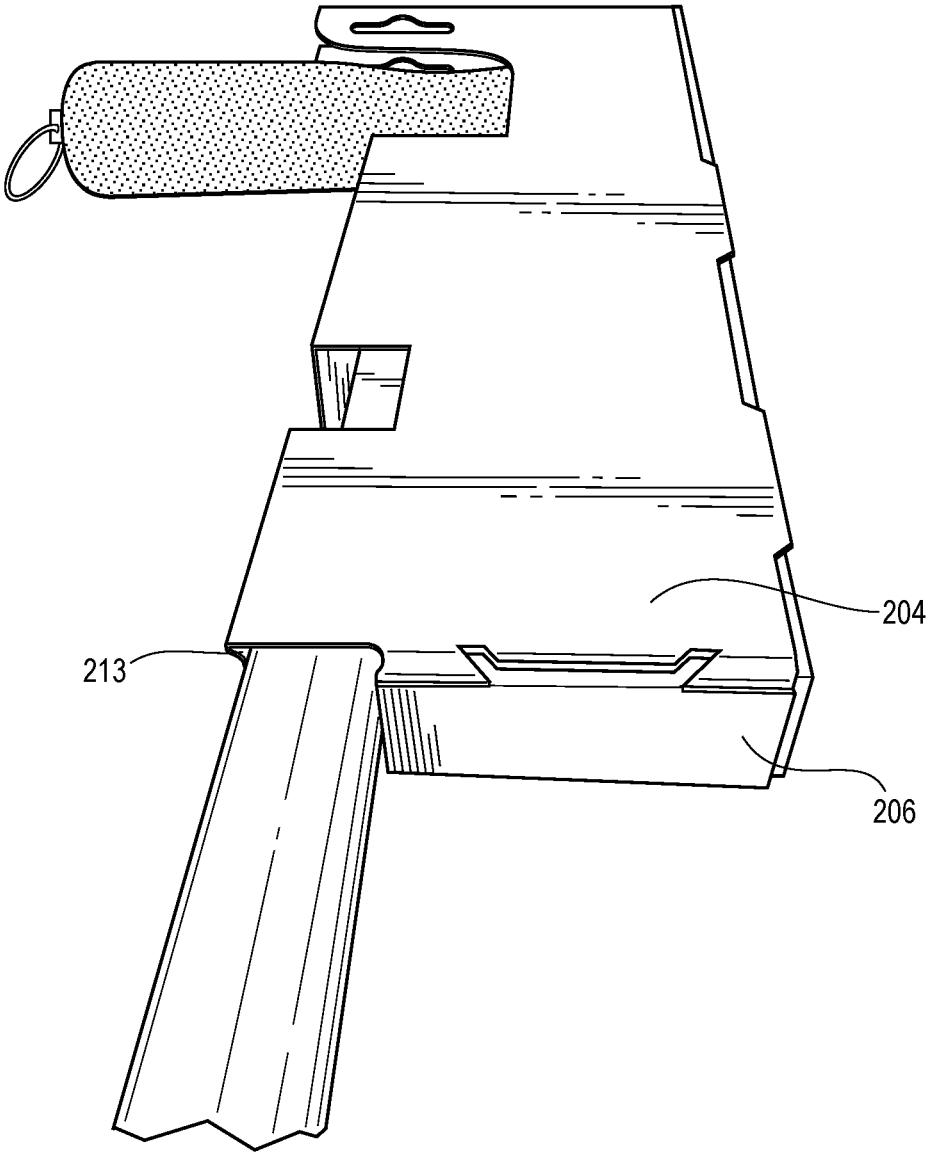
FIG. 11 is a perspective view illustrating a rear panel of the display package.
Figure 12:
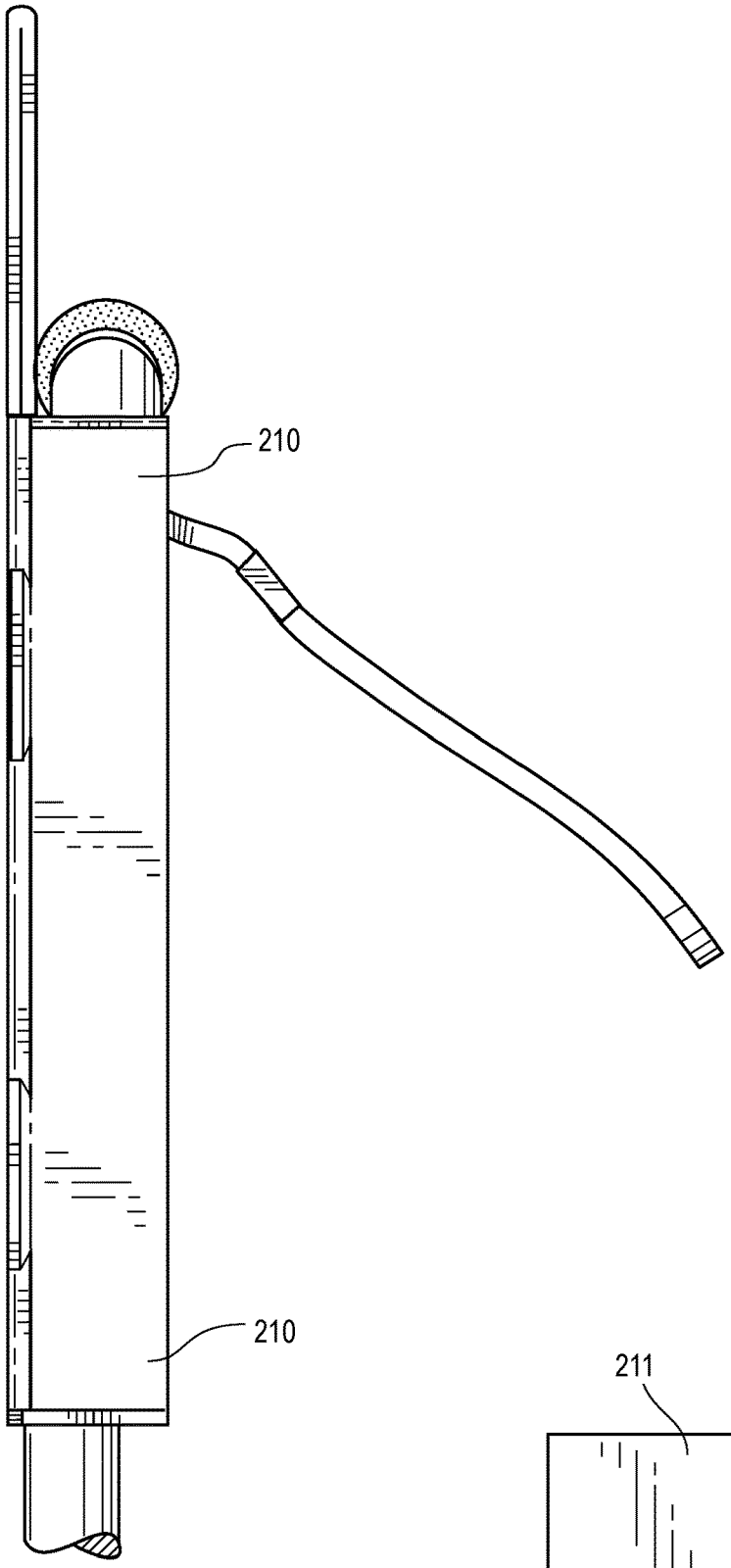
FIG. 12 is a side elevational view illustrating a first side panel of the display package.
Figure 13:
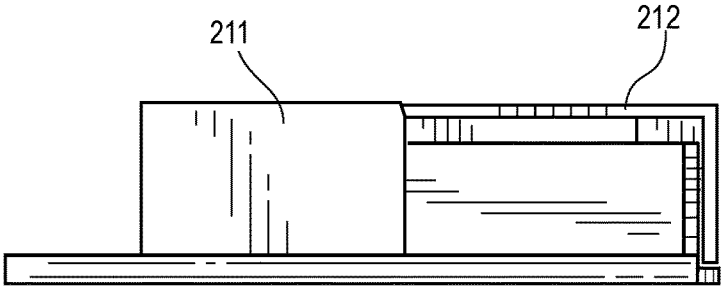
FIG. 13 is a top plan view illustrating a top panel of the display package.

With further reference to FIGS. 10 and 11, the second side panel 208 is equipped with a tubular support region 207, as discussed in more detail hereinbelow. The rear panel 204, shown in FIG. 11, is also sized to display graphics and consumer information, while the bottom panel 206 includes an aperture 213 to accommodate the shaft of the cane. With continuing reference to FIGS. 12 and 13, the first side panel 210 and top panel 211 are shown, the top panel 211 including an aperture 212 to accommodate the transition region of the cane, as shown for instance in FIG. 9. The front panel and rear panel each have a surface area that is larger than that of the side panels 208, 210, thereby maximizing the display space available to the consumer when the assembly is placed on a hanging hook and facing the consumer.

Figure 14:
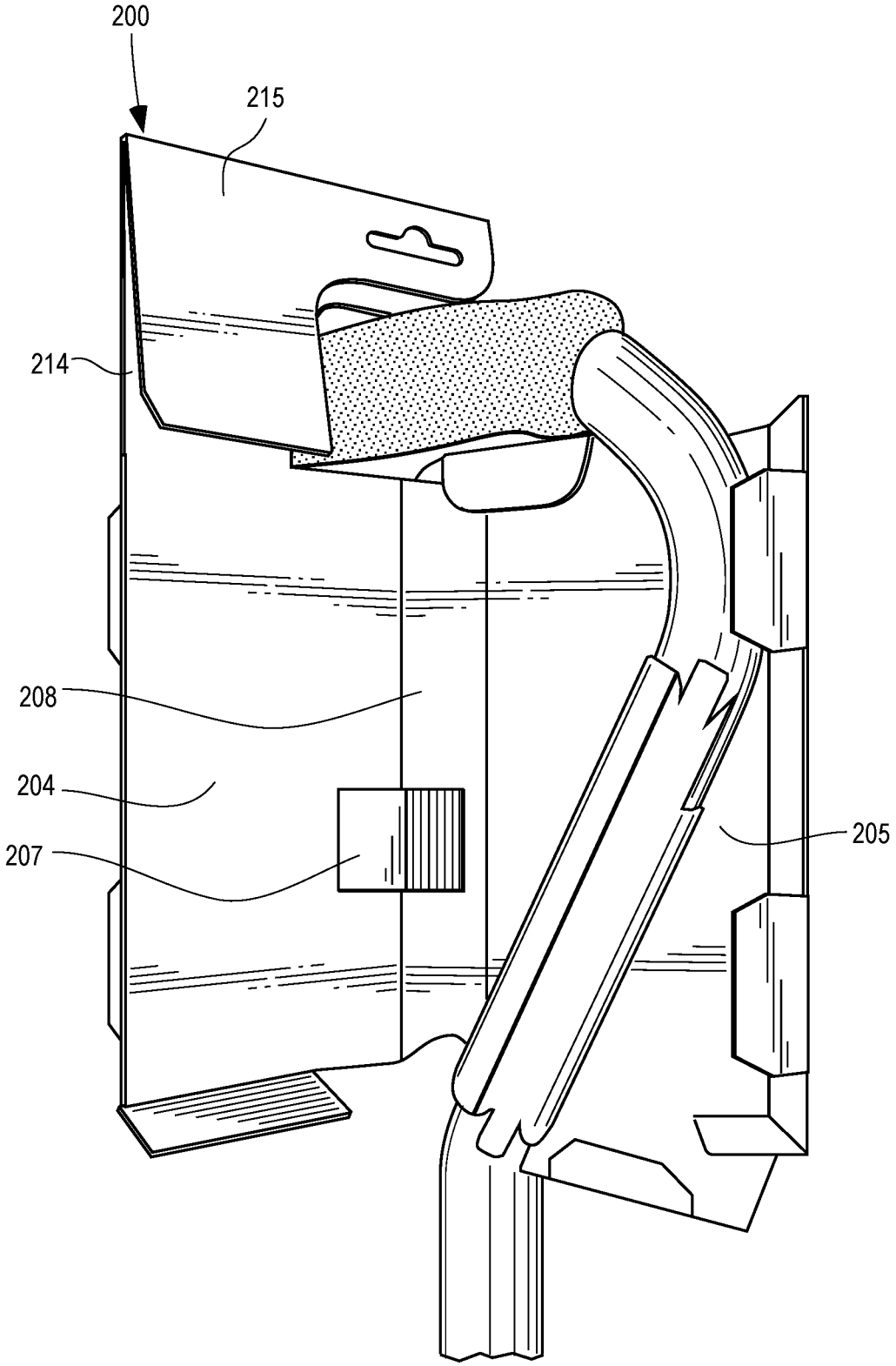
FIG. 14 is a perspective view illustrating the display package is a partially opened state.

The tubular support region is best illustrated in FIG. 14. As seen therein, the support region 207 is composed of inwardly folded portions of the rear panel 204 and the second side panel 208. The tubular support region provides structural support for the container formed by the front, side, top, and bottom panels, and inhibits crushing of the container during transport and handling. The hanging panel 208 is formed by folded-over panel portions 214, 215. FIG. 14 also shows interior packaging element 220.

Figure 15:
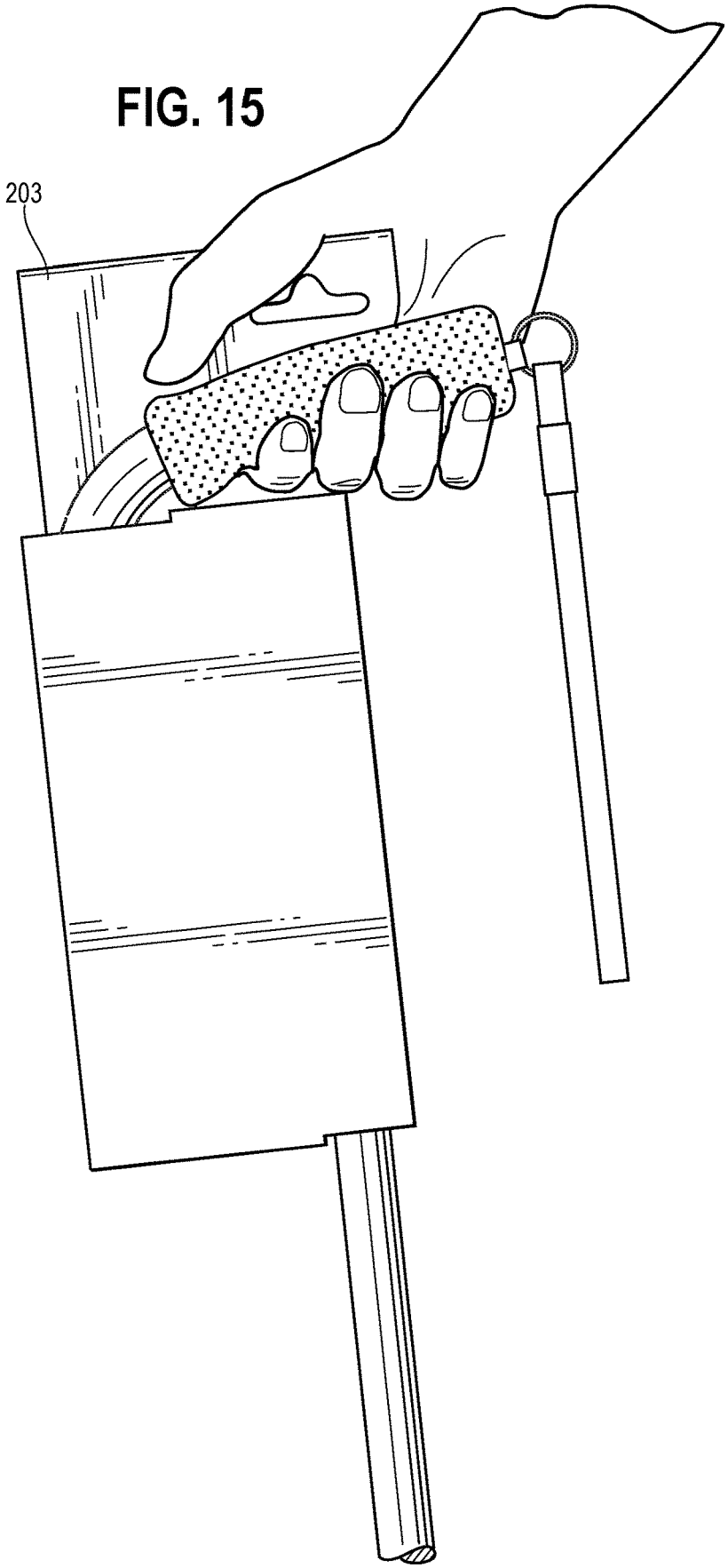
FIGS. 15 and 16 are front and rear perspective views, respectively, of a user grasping the handle of the cane while the display package remains affixed to the cane.
Figure 16:
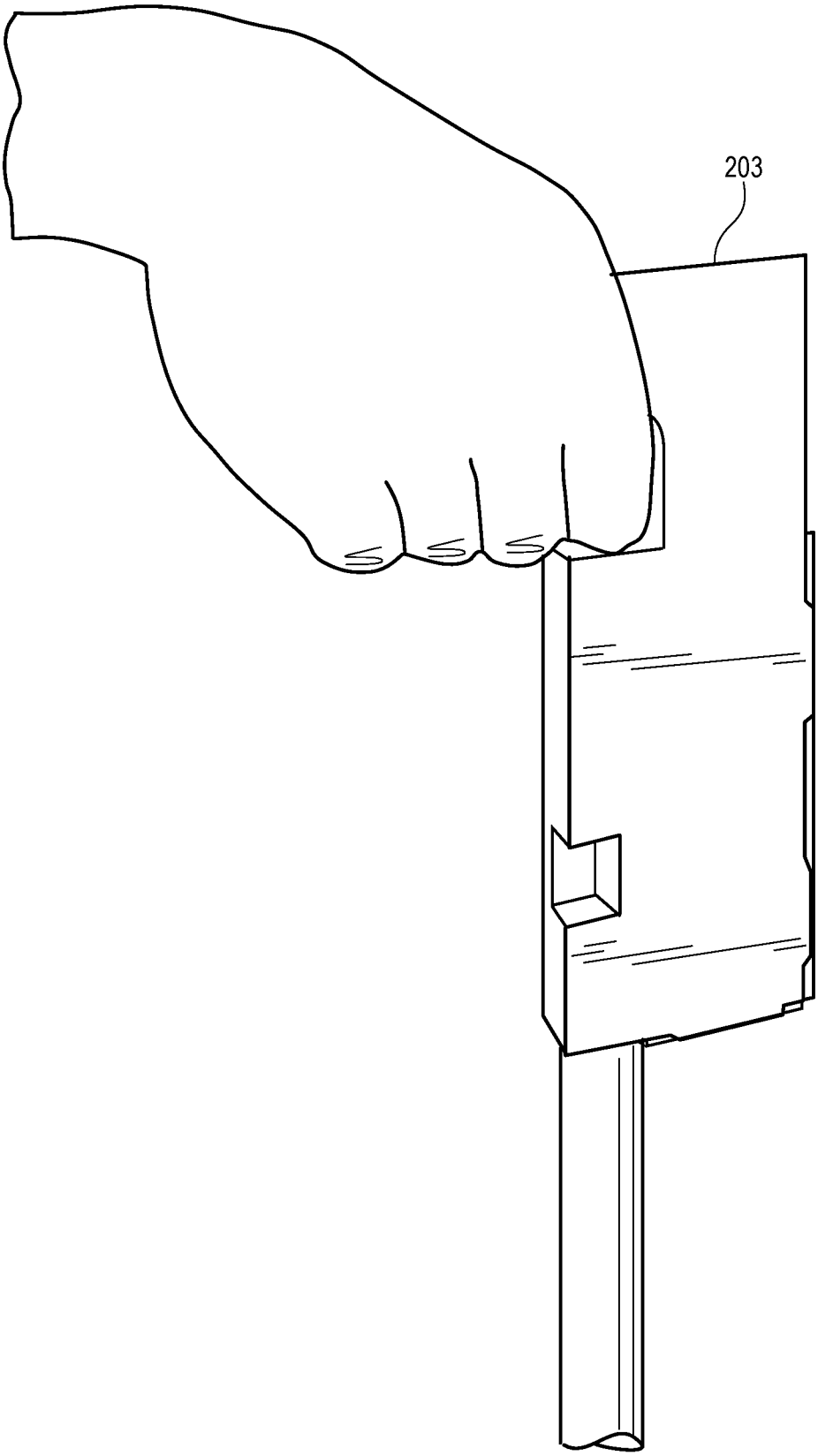

As seen in FIGS. 15 and 16, the hanging panel 203 has a lower boundary that defines an open region near the handle region. This permits manual grasping of the handle region while not requiring removal of the cane from the display package. The user may wrap his or her hands around the handle of the cane, optionally grasping the portion of the hang tab region. Via this approach, the user may test the cane prior to sale at the point-of-purchase to determine suitably of the cane for the user's needs.

Figure 18:
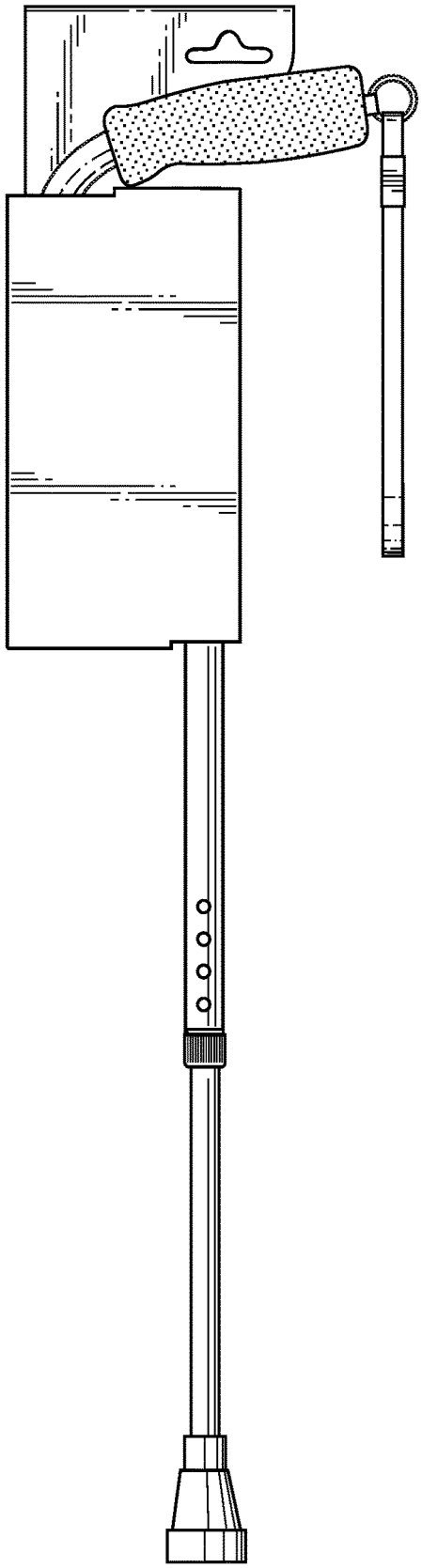
FIG. 18 is a front elevational view of the assembly.
Figure 19:
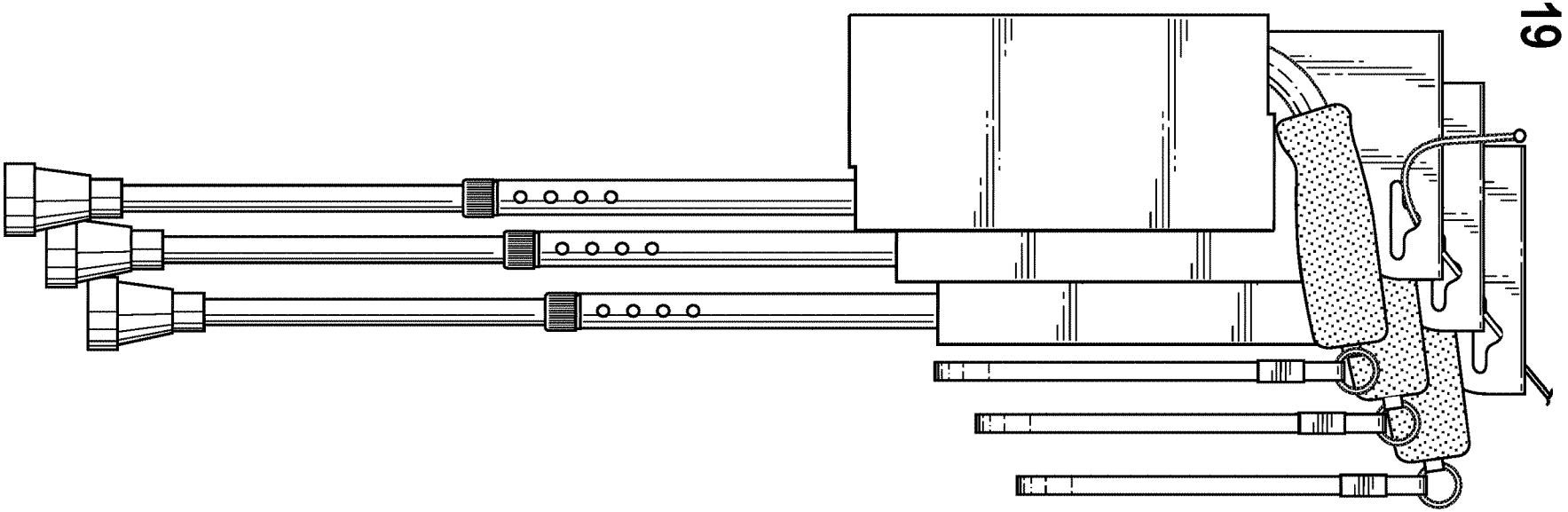
FIG. 19 is a perspective view of a plurality of assemblies hanging on a display hook.

In practice, the assembly may be configured and sized such that the shaft of the mobility device rests within 5 degrees of vertical in the direction forward or away from a direction facing the front panel (i.e., into and out of the page with regard to a user facing the assembly, as shown in FIG. 18). This allows a plurality of such devices to be displayed in a display unit having an elongate hook, as shown in FIG. 19, with the devices resting neatly and hanging substantially vertically in the display unit. The telescoping shaft may be partially or fully retracted, at the option of the retailer, when positioned for display.

Figure 17:
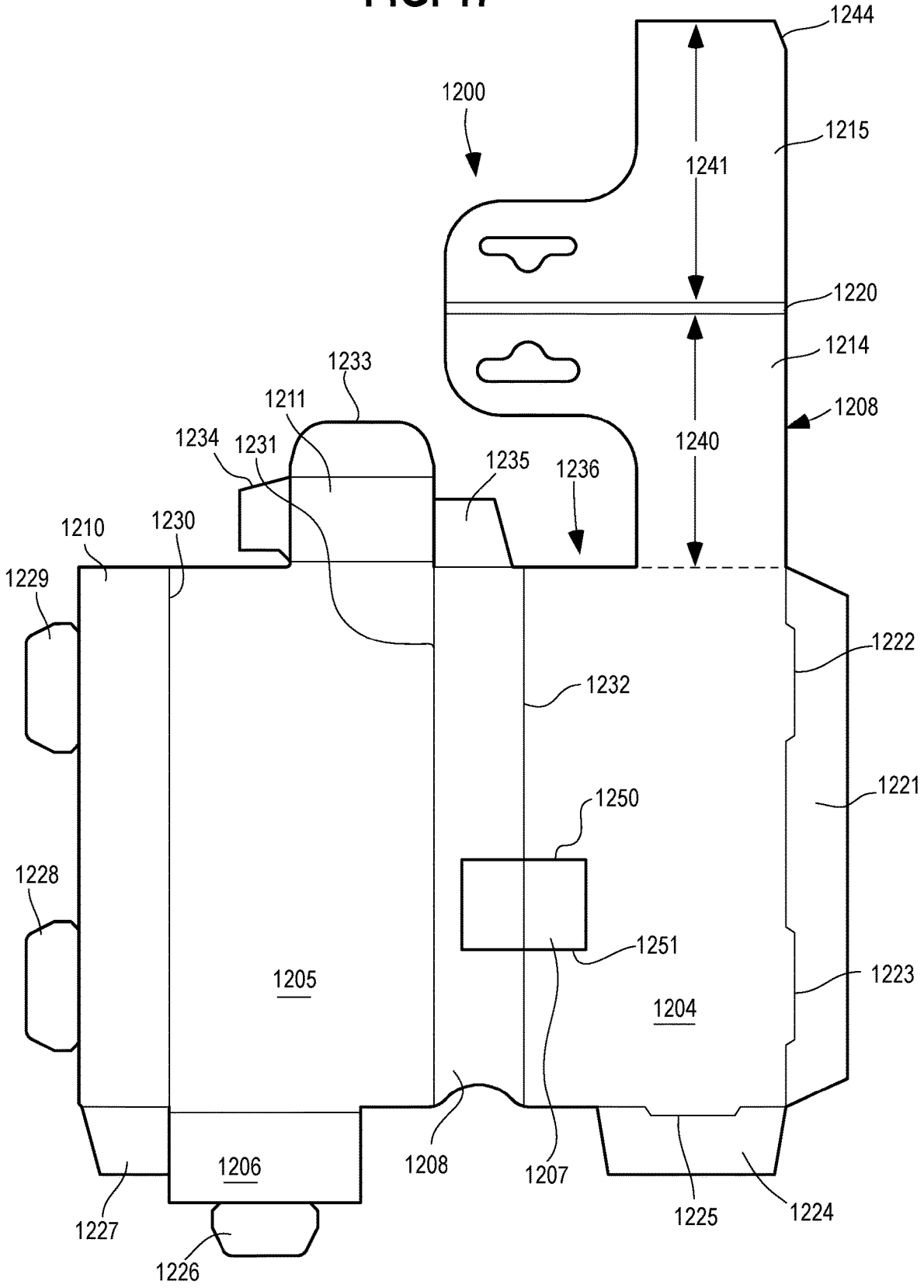
FIG. 17 is a plan view of a packaging blank for the display package heretofore illustrated.

As heretofore described, the display package may be folded from a package blank, such as the package blank 1200 illustrated in FIG. 17. The package blank preferably is configured to allow folding of the package without any adhesive, such that mechanical retention of the various portions of the package with respect to one another are effectuated, as described in more detail below. The exemplary package blank 1200 includes a front panel portion 1205 and a rear panel portion 1204, and first and second side panel portions 1210, 1208 respectively. The front panel portion 1205 is connected to the first side panel portion 1210 at a first front side fold line 1230 and connected to the second side panel portion at a second front side fold line 1231. The rear panel portion 1204 is connected to the second side panel portion 1208 at a rear side fold line 1232. At least one side tab is disposed on one of the first side panel portion and the rear panel portion. In this embodiment, the first side panel portion 1210 includes side tabs 1228, 1229. The rear panel portion includes an interior side panel portion 1221 that cooperates with the rear panel portion 1204 to define slots 1222 and 1223 which receive the tabs 1228 and 1229. The slots may be formed at the region between the interior side panel portion 1221 and the rear panel portion 1204, or may be formed separately in the interior side panel portion 1221.

The blank 1200 includes a bottom panel portion 1206 having a bottom tab 1226. In this embodiment, the bottom panel portion is connected to the front panel portion 1205 although it might alternatively be connected to the rear panel portion 1204. In the illustrated configuration, the rear panel portion 1204 is equipped with a bottom interior panel portion 1224 that defines a slot 1225 in the same manner as slots 1222 and 1223. The blank 1200 further includes a top panel portion 1211 having top panel portion flaps 1233, 1234, 1235. The flap 1235 opposes bottom flap 1227 when assembled, and these flaps impart additional structural support.

Extending from the rear panel portion 1204, and integral therewith, is a hanging panel portion 1208. As illustrated, the hanging panel portion 1208 is composed of a first hanging panel part 1214 and a second hanging panel part 1215, the longitudinal dimension 1241 of the second hanging panel part 1215 being greater than the longitudinal extension 1240 of the first hanging panel part 1214 past the top edge 1236 of the rear panel portion 1204. The first and second hanging panel parts are connected to one another at a fold region 1220, which, in the illustrated embodiment, comprises dual folds. By virtue of dimension 1241 being larger than dimension 1240, a small tab portion 1244 is retained beneath top edge 1236 of the container when assembled to thereby retain the second hanging panel part 1215 in a folded state. As seen, tubular support slits 1250, 1251 extend across the rear side fold line 1232, preferably to an equal extent across each side of this fold line. The tubular slits may be positioned alternatively across fold lines 1231 or 1234.

In practice, the container blank is preferably fashioned from cardboard or heavy paper. The container is folded over the transition region of the cane, rendering the assembly suitable for a point-of-sale hanging display.

All methods described herein can be performed in any suitable order unless otherwise indicated herein or otherwise clearly contradicted by context. The use of any and all examples, or language describing an example (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. An assembly comprising a user mobility device and a display package;

the user mobility device comprising a handle region optionally covered by a handle cover; a transition region, and a support region;

the display package comprising a front panel and a rear panel, and first and second side panels, said front panel being connected to said first side panel at a first front side edge and connected to said second side panel at a second front side edge; said rear panel being connected to said first side panel at a first rear side edge and connected to said second side panel at a second rear side edge, said front panel and rear panel each being larger in surface area than each of said first and second side panels;

the display package comprising a bottom panel having a bottom aperture for accommodating said support region and a top panel having a top aperture for accommodating said transition region;

said display package further comprising a hanging panel, the hanging panel having a hang tab region that extends past the handle region of the user mobility device, the hang tab region having a hanging aperture;

said front, rear, top, bottom, and first and second side panels defining a container, said container being sized to envelop at least a portion of said transition region of said mobility device and sized to retain said user mobility device in a hanging position;

the hanging panel having a boundary that defines an open region proximal the handle region to permit manual grasping of the handle region without removal of said user mobility device from said display package.

2. An assembly according to claim 1, said hanging aperture having a slot configuration.

3. An assembly according to claim 1, said display package including interior corner support region, the corner support region comprising an inwardly folded portion of one of said front and rear panels and one of said first and second side panels.

4. An assembly according to claim 3, said corner support region comprising an inwardly folded portion of said rear panel and one of said side panels.

5. An assembly according to claim 1, said support region of said user mobility device comprising an elongate shaft, said shaft having an axis, said display package being sized with respect to said mobility device to allow said axis to rest within 5 degrees of vertical in the direction forward or away from a direction facing said front panel.

6. An assembly according to claim 5, said shaft being a telescoping shaft having a lock mechanism to affix said shaft alternately in at least a first and a second position.

7. An assembly according to claim 1, said hanging panel extending from said rear panel.

8. An assembly according to claim 7, said hanging panel comprising a first hanging panel section extending from said rear panel and a second hanging panel section folded over said first hanging panel section.

9. An assembly according to claim 1, said display package being folded from a monolithic package blank.

10. An assembly according to claim 9, said display package being non-adhesively folded from a monolithic package blank.

11. A display rack comprising an elongate display hook and plural assemblies, each assembly comprising an assembly according to claim 1.

12. A display package blank, comprising:

a front panel portion and a rear panel portion, and first and second side panel portions, said front panel portion being connected to said first side panel portion at a first front side fold line and connected to said second side panel portion at a second front side fold line; said rear panel portion being connected to said second side panel portion at a rear side fold line, said front panel and rear panel portions each being larger in surface area than each of said first and second side panel portions;

a side tab disposed on one of said first side panel portion and said rear panel portion, the other of said first side panel portion and said rear panel portion including an interior side panel portion defining a slot sized to retain the side tab;

a bottom exterior panel portion connected to one of said front panel portion and said rear panel portion and having a bottom tab, and a bottom interior panel portion connected to the other of front panel portion and said rear panel portion and defining a slot sized to retain the bottom tab, said bottom interior and exterior panel portions having a lateral dimension that is smaller than the lateral dimension of each of said front panel portion and said rear panel portion;

a top panel portion connected to said front panel portion, said top panel portion having a lateral dimension that is smaller than the lateral dimension of each of said front panel portion and said rear panel portion;

a hanging panel portion extending from said rear panel portion, the hanging panel having a hang tab region spaced from an upper edge of said rear panel portion, the hanging panel portion including a hanging aperture, the hanging panel portion having a boundary that defines an open region proximal said upper edge.

13. A display package blank according to claim 12, said side tab being disposed on said first side panel portion and said interior side portion being disposed on said rear panel portion.

14. A display package blank according to claim 12, said hanging panel portion comprising a first hanging panel part extending from said rear panel and a second hanging panel part connected to said first hanging panel part at a fold region, said second hanging panel part having a longitudinal dimension that is larger than the longitudinal dimension of said first hanging panel part.

15. A display package blank according to claim 12, including a pair of tubular support slits extending across one of said first front side fold line; second front side fold line; and rear side fold line.

16. A display package blank according to claim 15, said pair of tubular support slits extending across said rear side fold line.

* * * * *